US009115509B2

(12) United States Patent
Huang et al.

(10) Patent No.: US 9,115,509 B2
(45) Date of Patent: Aug. 25, 2015

(54) ADJUSTABLE BUTTON APPARATUS OF LOCK

(71) Applicant: TAIWAN FU HSING INDUSTRIAL CO., LTD., Kaohsiung (TW)

(72) Inventors: Chao-Ming Huang, Kaohsiung (TW); Wen-Chieh Lee, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 245 days.

(21) Appl. No.: 13/833,222

(22) Filed: Mar. 15, 2013

(65) Prior Publication Data

US 2014/0238180 A1 Aug. 28, 2014

(30) Foreign Application Priority Data

Feb. 23, 2013 (TW) ..... 102106443 A

(51) Int. Cl.

| | |
|---|---|
| ***E05B 1/00*** | (2006.01) |
| ***E05B 3/04*** | (2006.01) |
| ***E05B 63/00*** | (2006.01) |
| ***E05B 3/00*** | (2006.01) |

(52) U.S. Cl.

CPC ... *E05B 3/04* (2013.01); *E05B 3/00* (2013.01); *E05B 63/006* (2013.01); *Y10T 74/20468* (2015.01)

(58) Field of Classification Search

CPC ..... E05B 63/006; Y10S 292/60
USPC ..... 292/347, DIG. 37
See application file for complete search history.

(56) References Cited

U.S. PATENT DOCUMENTS

| | | | | |
|---|---|---|---|---|
| 4,192,537 | A | 3/1980 | Laine | |
| 4,920,773 | A | 5/1990 | Surko, Jr. | |
| 5,934,117 | A * | 8/1999 | Shen | 70/224 |
| 6,929,290 | B2 * | 8/2005 | Don | 292/169 |
| 2011/0219832 | A1 | 9/2011 | Lin | |
| 2012/0200095 | A1 * | 8/2012 | Wang et al. | 292/143 |

FOREIGN PATENT DOCUMENTS

| | | |
|---|---|---|
| AU | 2011200907 A1 | 9/2012 |
| TW | M258146 | 3/2005 |

OTHER PUBLICATIONS

Taiwanese Office Action mailed Nov. 18, 2014 for Taiwanese Patent Application No. 102106443, 5 pages.

* cited by examiner

*Primary Examiner* — Mark Williams
(74) *Attorney, Agent, or Firm* — Jackson IPG PLLC; Demian K. Jackson

(57) ABSTRACT

An adjustable button apparatus of a lock includes an adjusting sleeve, a transmission rod, a driving plate and a positioning pin, the adjusting sleeve is movable between a positioning position and an adjusting position. When the adjusting sleeve is located at the positioning position, the adjusting sleeve presses the positioning pin and makes the positioning pin engaged with the transmission rod and the driving plate, when the adjusting sleeve is located at the adjusting position, the positioning pin separates apart from the driving plate to make the driving plate transversely movable in the transmission rod. Via the positioning pin inserted at various positions of the driving plate for adjusting a joint length formed by jointing the transmission rod and the driving plate, the lock is applicable for installation in doors of various door thicknesses.

19 Claims, 11 Drawing Sheets

ADJUSTABLE BUTTON APPARATUS OF LOCK

FIELD OF THE INVENTION

The present invention is generally related to an adjustable button apparatus of a lock applicable for installation in doors of various door thicknesses through a joint length formed by jointing a transmission rod and a driving plate.

BACKGROUND OF THE INVENTION

A conventional lock is applicable for installation in doors of various thicknesses by an adjustable interval between two mounting assemblies and a length-adjustable button apparatus.

Please refer to U.S. Pat. No. 6,929,290 "an adjustable button mechanism of a lock" and FIG. 1, an adjustable button apparatus 10 includes a cylinder 11, a body 12 and a button 13, one end of the body 12 is inserted inside the cylinder 11, and another end of the body 12 is inserted inside the button 13. The button 13 comprises a plurality of positioning holes 13*a*, the body 12 comprises an elastic member 12*a* and a positioning member 12*b*, one end of the positioning member 12*b* engages with the elastic member 12*a*, and another end of the positioning member 12*b* is limited within the positioning hole 13*a*. The length of the button apparatus 10 is changeable by pressing the positioning member 12*b* with a tool (not shown in FIG.) so as to make the positioning member 12*b* separate from the positioning hole 13*a* and thereafter move the button 13. As long as the positioning member 12*b* corresponds to proper positioning hole 13*a*, the positioning member 12*b* is then restored and limited within the positioning hole 13*a*. However, it is difficult to control the pressed force of the tool applying on the positioning member 12*b*, an unstable pressed force likely causes displacement of the elastic member 12*a* and makes the positioning member 12*b* unable to be restored in the positioning hole 13*a*.

SUMMARY

The primary object of an adjustable button apparatus of a lock in the present invention is to adjust a joint length formed by jointing a transmission rod and a driving plate. An adjusting sleeve is movable between a positioning position and an adjusting position for adjusting the joint length formed by jointing the transmission rod and the driving plate so that the lock is applicable for installation in doors of various thicknesses.

An adjustable button apparatus of a lock includes an adjusting sleeve, a transmission rod, a driving plate, a positioning pin and a button, wherein the adjusting sleeve is movable between a positioning position and an adjusting position, the transmission rod is inserted into the adjusting sleeve and comprises an insertion hole, the driving plate is inserted into the insertion hole and comprises a body and a plurality of positioning holes formed at the body, the button is engaged with the driving plate, and the positioning pin is engaged with the transmission rod and being movable in response to the adjusting sleeve. When the adjusting sleeve is located at the positioning position, the positioning pin is inserted into one of the positioning holes of the driving plate to make the driving plate fixedly positioned in the insertion hole of the transmission rod, otherwise, when the adjusting sleeve is located at the adjusting position, the positioning pin separates apart from the positioning hole to make the driving plate movable in the insertion hole of the transmission rod for adjusting the joint length formed by jointing the transmission rod and the driving plate.

The adjustable button apparatus of the lock of the present invention enables to adjust the joint length formed by jointing the transmission rod and the driving plate without using a tool and makes the lock applicable for installation in doors of various door thicknesses. When the adjusting sleeve of the present invention is located at the positioning position, the positioning pin is pressed by the adjusting sleeve to make the positioning pin inserted into the driving plate and to make the driving plate engage with the transmission rod so that the transmission rod and the driving plate act simultaneously. When the joint length longs for adjustment, the adjusting sleeve moves from the positioning position to the adjusting position to make the positioning pin separate apart from the driving plate so that the driving plate is transversely movable in the transmission rod for adjusting the joint length formed by jointing the transmission rod and the driving plate. Thereafter, the adjusting sleeve moves from the adjusting position to the positioning position so as to make the positioning pin pressed by the adjusting sleeve once again and to force the positioning pin to insert into the driving plate for achieving joint length adjustment.

DETAILED DESCRIPTION OF THE INVENTION

Figure 1:
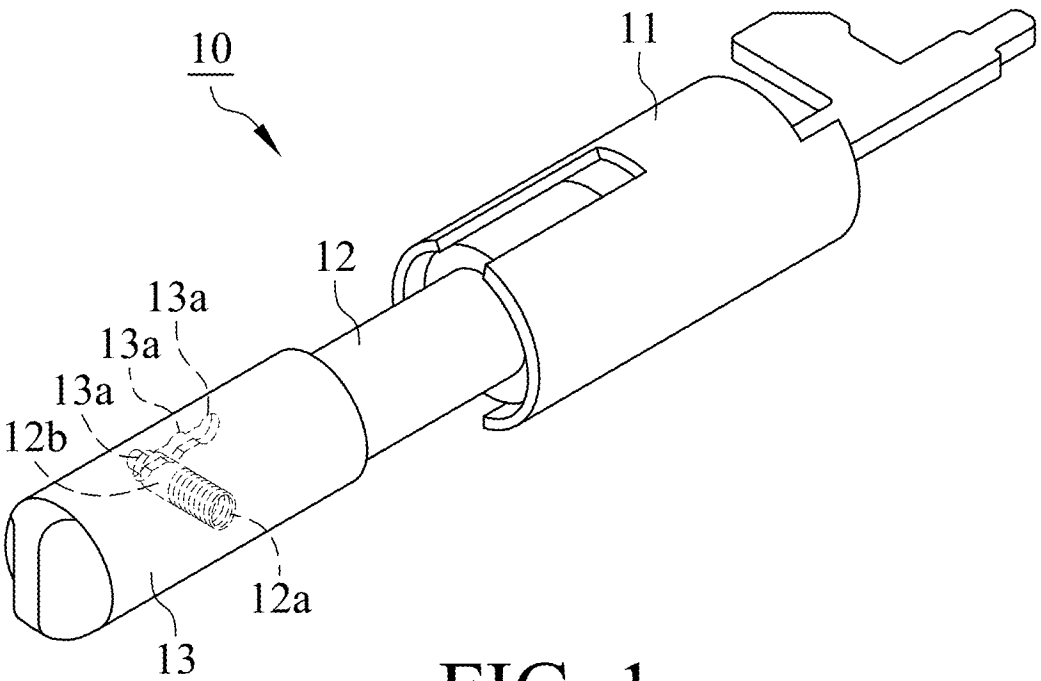
FIG. 1 PRIOR ART
FIG. 1 is a diagram illustrating a conventional adjustable button apparatus.
Figure 2:
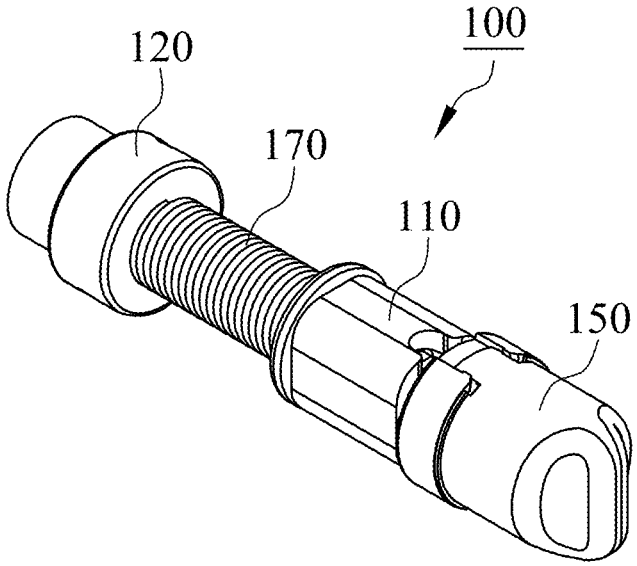
FIG. 2 is a perspective assembly view illustrating an adjustable button apparatus of a lock in accordance with an embodiment of the present invention.
Figure 3:
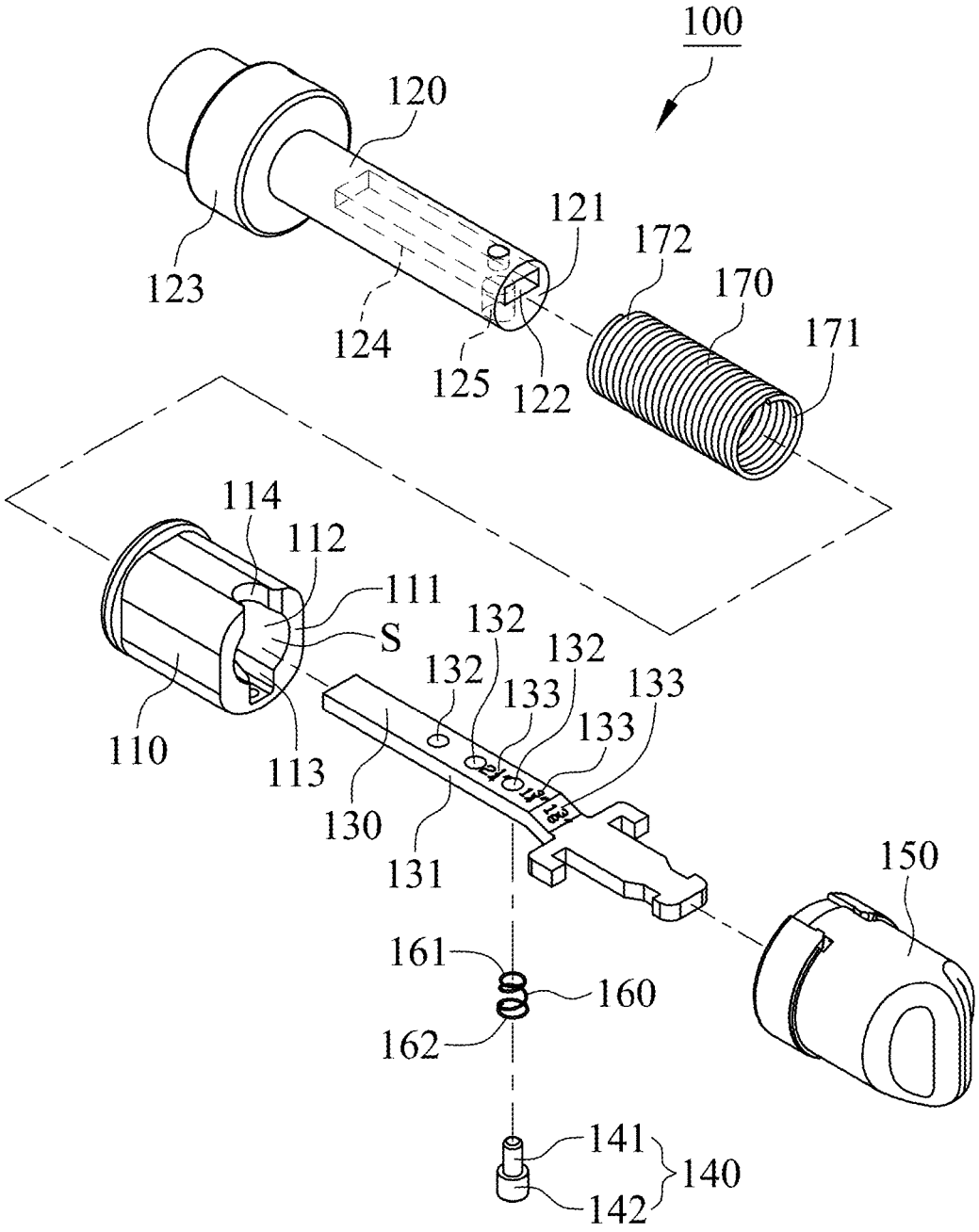
FIG. 3 is a perspective exploded view illustrating the adjustable button apparatus of the lock in accordance with the embodiment of the present invention.
Figure 4:
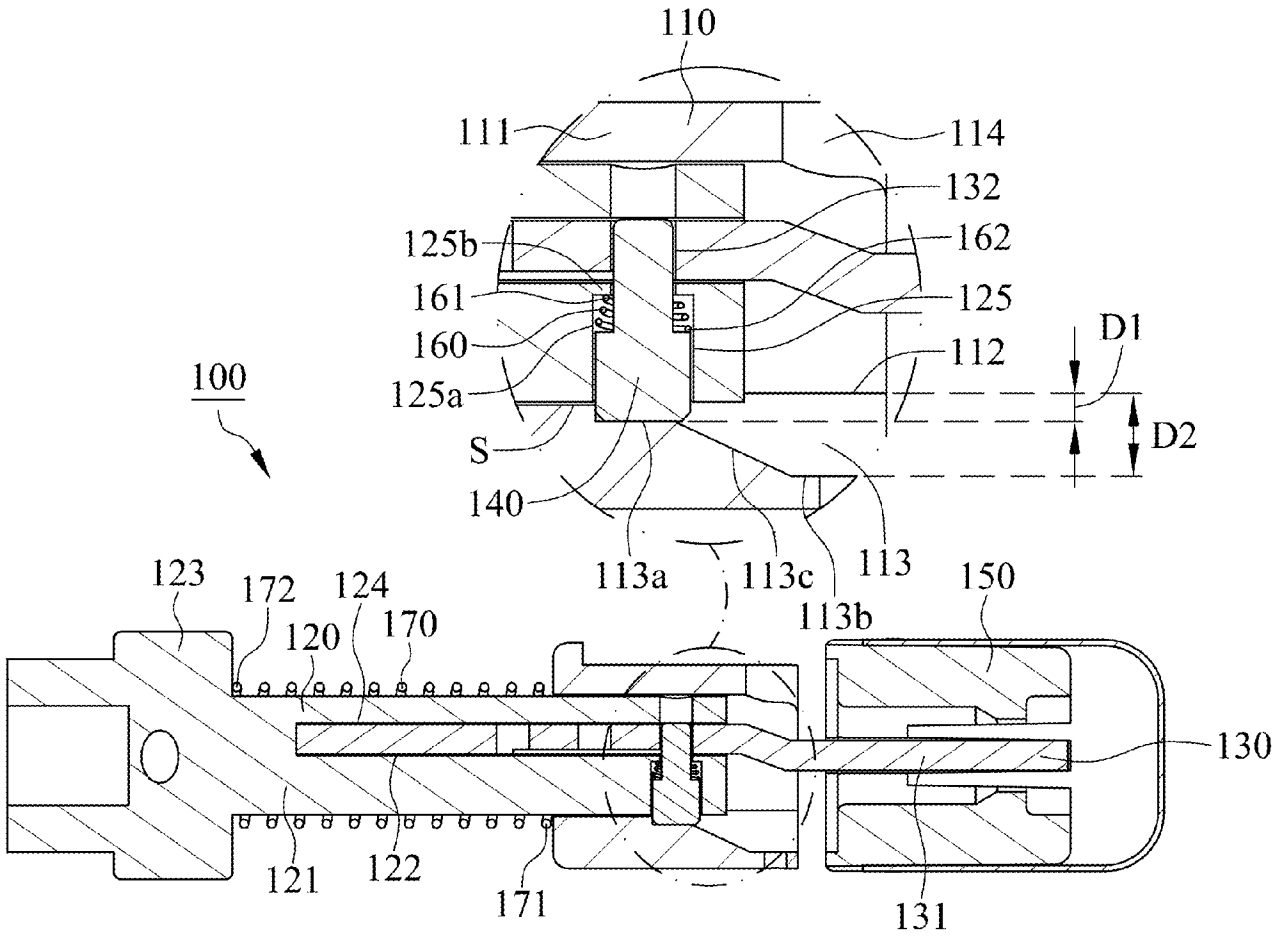
FIG. 4 is a section view illustrating the adjustable button apparatus of the lock in accordance with the embodiment of the present invention.

With reference to FIGS. 2, 3 and 4, an adjustable button apparatus of a lock 100 in accordance with an embodiment of the present invention includes an adjusting sleeve 110, a transmission rod 120, a driving plate 130, a positioning pin 140 and a button 150, wherein the button 150 is engaged with the driving plate 130 to drive the driving plate 130, and the positioning pin 140 is movably disposed within the adjusting sleeve 110. Please refer to FIGS. 3 and 4, the adjusting sleeve 110 comprises a first ring wall 111 and an accommodating space S surrounded by the first ring wall 111, the transmission rod 120 comprises a second ring wall 121, an insertion hole 122 and a blocking portion 123, the insertion hole 122 is surrounded by the second ring wall 121. The second ring wall 121 comprises an inner surface 124 and a limiting hole 125, and the limiting hole 125 is recessed to the inner surface 124 and communicates with the insertion hole 122. The blocking portion 123 protrudes from the second ring wall 121, the positioning pin 140 is disposed within the limiting hole 125, and the transmission rod 120 is inserted into the adjusting sleeve 110. Referring to FIGS. 3 and 4, the driving plate 130 comprises a body 131 and a plurality of positioning holes 132 formed at the body 131. In this embodiment, the positioning holes 132 of the driving plate 130 penetrate through the body 131. With reference to FIG. 4, the transmission rod 120 is inserted into the accommodating space S of the adjusting sleeve 110, the driving plate 130 is inserted into the insertion hole 122, and the positioning pin 140 disposed within the limiting hole 125 contacts against the first ring wall 111. In this embodiment, the first ring wall 111 comprises an interior surface 112 and a guiding slot 113 recessed to the interior surface 112, the positioning pin 140 contacts against the guiding slot 113 of the first ring wall 111, and the positioning pin 140 is movable in response to the adjusting sleeve 110. In this embodiment, the positioning pin 140 moves up and down in response to the movement of the adjusting sleeve 110.

With reference to FIGS. 3 and 4, the adjustable button apparatus of the lock 100 further includes a first elastic member 160 disposed within the limiting hole 125, the first elastic member 160 comprises a first end 161 and a second end 162, the first end 161 contacts against the transmission rod 120, and the second end 162 presses the positioning pin 140 so as to make the positioning pin 140 contact against the adjusting sleeve 110. In this embodiment, the first elastic member 160 is a compression spring, and the first elastic member 160 is mounted around the positioning pin 140. The limiting hole 125 comprises a hole surface 125*a* and a protrusion 125*b* protruded from the hole surface 125*a*. The positioning pin 140 comprises a positioning portion 141 and a fixing portion 142, and the positioning portion 141 protrudes from the fixing portion 142. The first end 161 of the first elastic member 160 contacts against the protrusion 125*b*, the second end 162 of the elastic member 160 contacts against the fixing portion 142 of the positioning pin 140 to make the fixing portion 142 protruded from the second ring wall 121 and contacting the adjusting sleeve 110. In this embodiment, the fixing portion 142 contacts against the guiding slot 113 of the adjusting sleeve 110. Referring to FIGS. 3 and 4, the adjustable button apparatus of the lock 100 further includes a second elastic member 170 having a first leaning terminal 171 and a second leaning terminal 172. In this embodiment, the second elastic member 170 is a compression spring. The second elastic member 170 is mounted around the transmission rod 120, the first leaning terminal 171 contacts against the adjusting sleeve 110, and the second leaning terminal 172 contacts against the blocking portion 123. When the position of the adjusting sleeve 110 is switched from an adjusting position to a positioning position, the second elastic member 170 provides the adjusting sleeve 110 with elasticity and makes the adjusting sleeve 110 restored to its original position.

Figure 5:
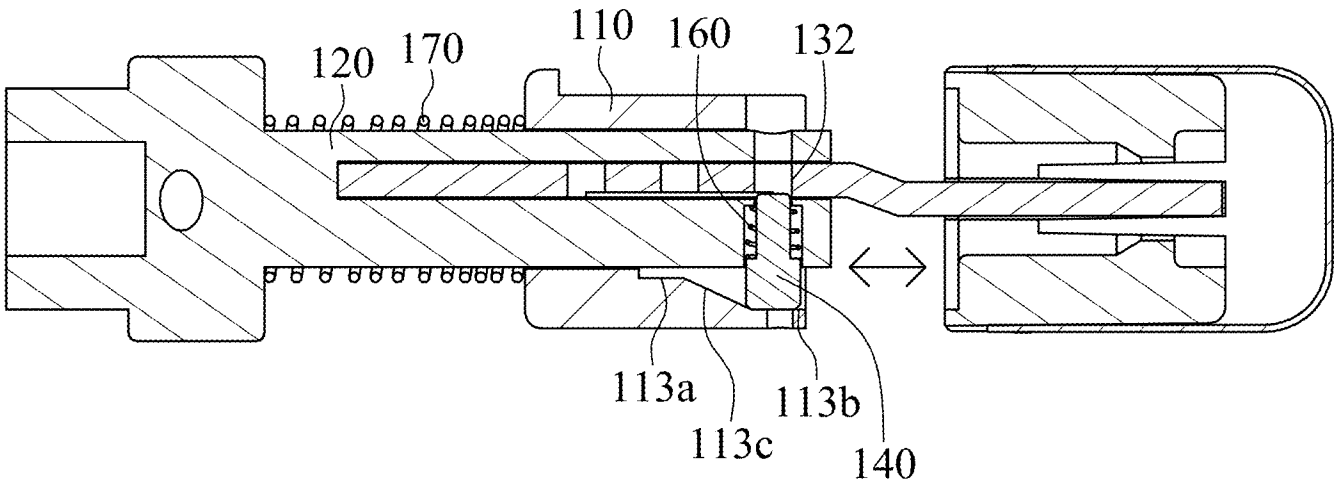
FIG. 5 is a section view illustrating the adjustable button apparatus of the lock in accordance with the embodiment of the present invention.

Referring to FIG. 4, the transmission rod 120 is inserted into the accommodating space S of the adjusting sleeve 110 when the adjusting sleeve 110 is located at the positioning position, the first ring wall 111 of the adjusting sleeve 110 presses the positioning pin 140 to make the positioning pin 140 inserted into one of the positioning holes 132 of the driving plate 130. Further, the driving plate 130 is positioned within the insertion hole 122 via the positioning pin 140. In this embodiment, the guiding slot 113 comprises a first bearing position 113*a*, a second bearing position 113*b* and a ramp surface 113*c*. The ramp surface 113*c* is connected to the first bearing position 113*a* and the second bearing position 113*b* and located between the first bearing position 113*a* and the second bearing position 113*b*. A first interval D1 is defined between the first bearing position 113*a* and the interior surface 112, a second interval D2 is defined between the second bearing position 113*b* and the interior surface 112, and the second interval D2 is larger than the first interval D1. When the adjusting sleeve 110 is located at the positioning position, the positioning pin 140 is in contact against the first bearing position 113*a*. In this embodiment, the positioning pin 140 contacts against the first bearing position 113*a* via the fixing portion 142, and the positioning pin 140 is compressed by the first ring wall 111 of the adjusting sleeve 110 to make the positioning portion 141 of the positioning pin 140 inserted into one of the positioning holes 132 of the driving plate 130. The first elastic member 160 is compressed by the positioning portion 141 therefore forming as a compressed state. Referring to FIG. 5, when the position of the adjusting sleeve 110 is switched from the positioning position to the adjusting position, the first elastic member 160 presses the positioning pin 140, the positioning pin 140 is biased toward the interior surface 112 of the first ring wall 111 of the adjusting sleeve 110 so that the positioning pin 140 is biased to separate apart from the positioning hole 132 of the driving plate 130 so that the driving plate 130 is transversely movable in the insertion hole 122 of the transmission rod 120. In this embodiment, when the adjusting sleeve 110 is located at the adjusting position, the positioning pin 140 contacts against the second bearing position 113*b*.

Figure 6:
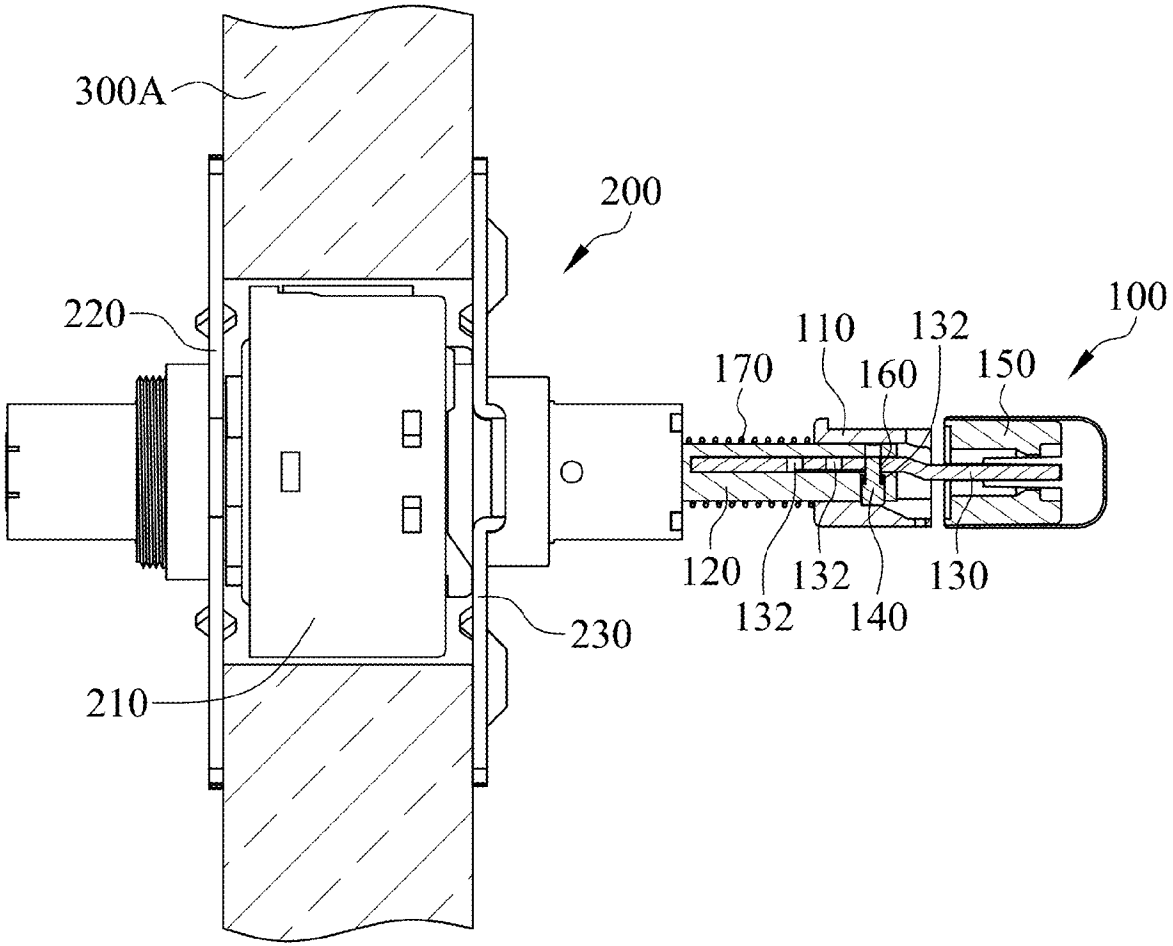
FIG. 6 is a section view illustrating the adjustable button apparatus of the lock disposed at a first door in accordance with the embodiment of the present invention.
Figure 7:
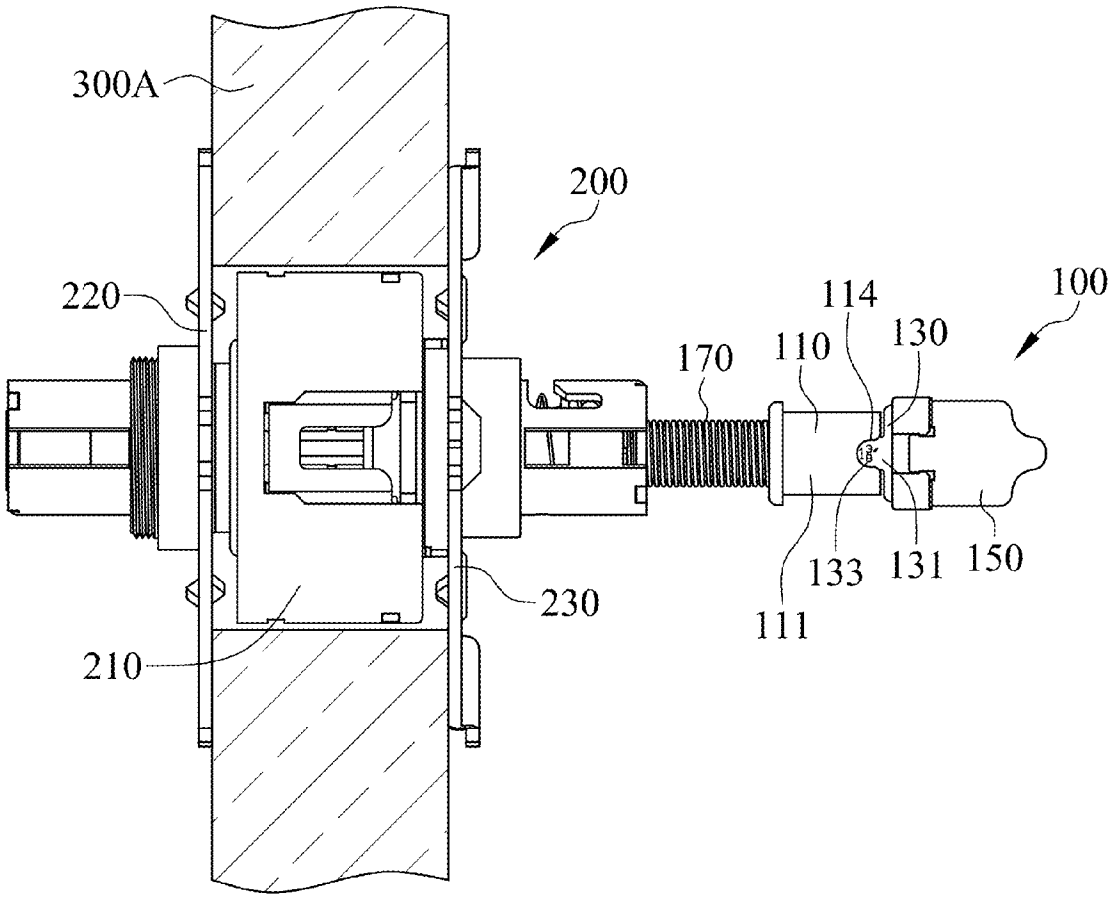
FIG. 7 is a top view illustrating the adjustable button apparatus of the lock disposed at the first door in accordance with the embodiment of the present invention.

With reference to FIGS. 4, 6 and 7, a first type for usage in the present invention is illustrated as followed. A lock 200 is disposed at a first door 300A, the lock 200 at least includes the adjustable button apparatus of the lock 100, a transmission mechanism 210, a first mounting plate 220 and a second mounting plate 230, wherein the transmission mechanism 210 is located between the first mounting plate 220 and the second mounting plate 230. The transmission mechanism 210 is mounted in the door 300A, and the first mounting plate 220 and the second mounting plate 230 are mounted at two sides of the door 300A respectively. The adjusting sleeve 110 is located at the positioning position. The first ring wall 111 of the adjusting sleeve 110 presses the fixing portion 142 of the positioning pin 140 to make the positioning portion 141 of the positioning pin 140 inserted into one of the positioning holes 132 of the driving plate 130. The positioning pin 140 contacts against the first bearing position 113*a* via the fixing portion 142 to make the positioning pin 140 engages with the transmission rod 120 and the driving plate 130. Referring to FIG. 7, preferably, the driving plate 130 comprises a plurality of size marks 133 formed on the body 131. When the positioning portion 141 of the positioning pin 140 is inserted into one of the positioning holes 132 of the driving plate 130, one size mark 133 corresponded to the positioning hole 132 is revealed by the adjusting sleeve 110. In this embodiment, the adjusting sleeve 110 further comprises an opening 114 formed at on the first ring wall 111, the size mark 133 is revealed by the adjusting sleeve 110 via the opening 114.

Figure 8:
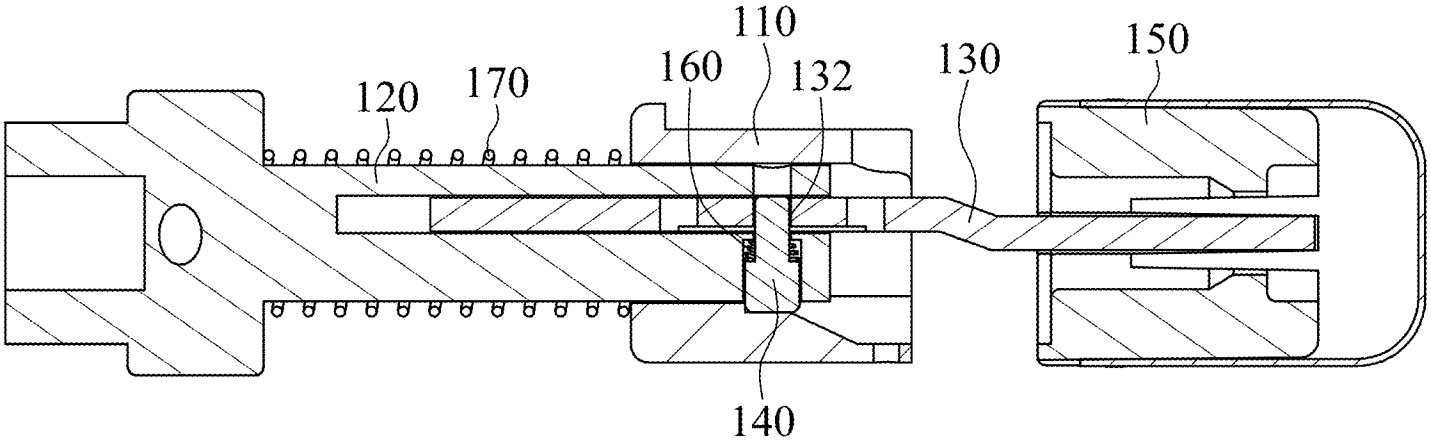
FIG. 8 is a section view illustrating a button of the adjustable button apparatus of the lock in accordance with the embodiment of the present invention.
Figure 9:
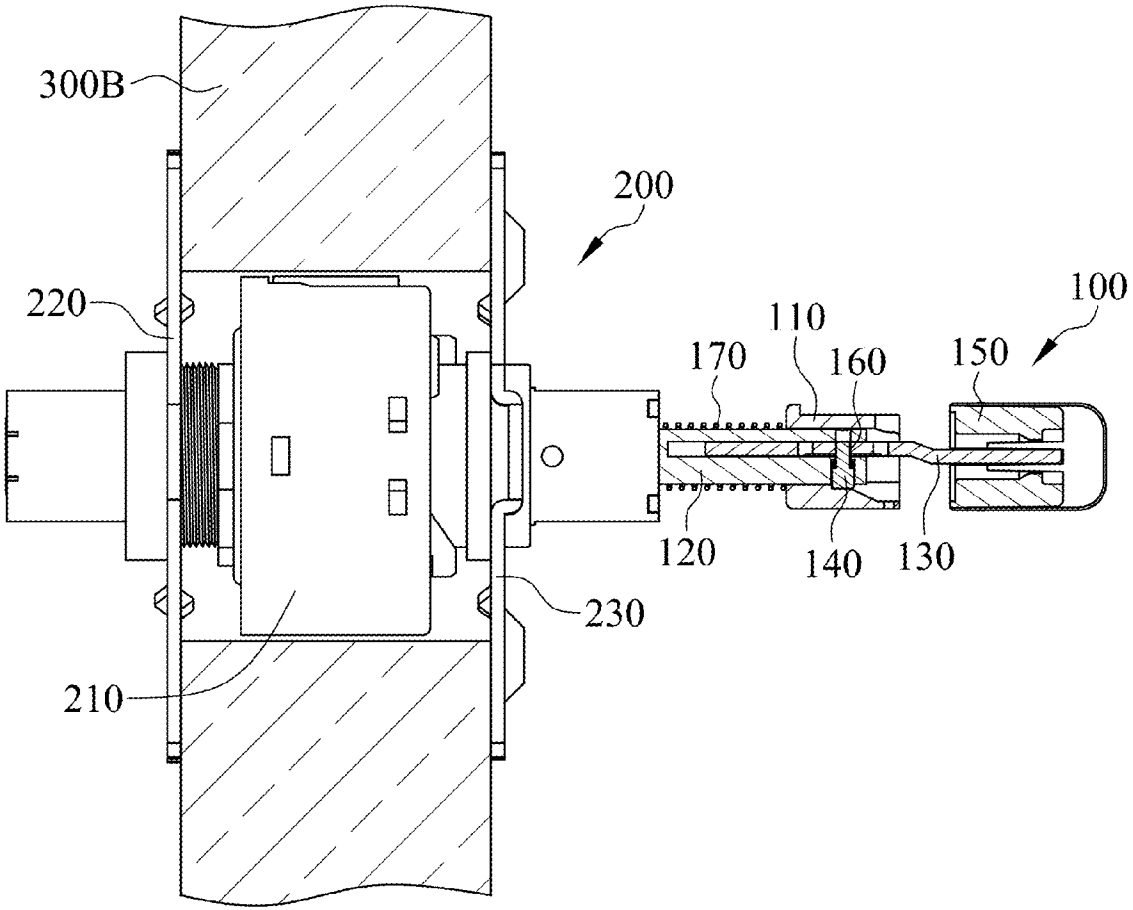
FIG. 9 is a section view illustrating the adjustable button apparatus of the lock disposed at a second door in accordance with the embodiment of the present invention.
Figure 10:
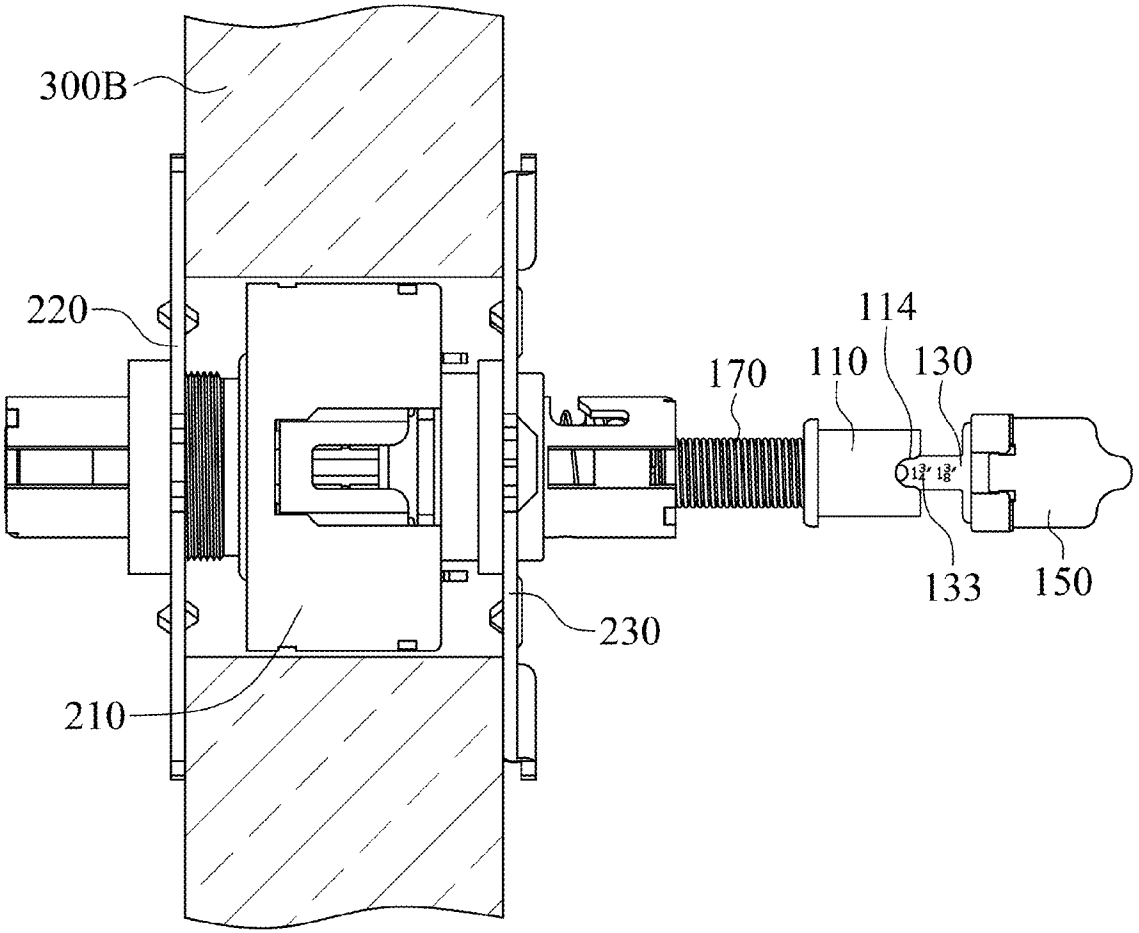
FIG. 10 is a top view illustrating the adjustable button apparatus of the lock disposed at the second door in accordance with the embodiment of the present invention.

With reference to FIGS. 8, 9 and 10, a second type for usage in the present invention is illustrated as followed. The lock 200 is disposed at a second door 300B. The position the positioning pin 140 inserted into the driving plate 130 is adjusted by the adjusting sleeve 110, owning to the reason that the thickness of the second door 300B is larger than that of the first door 300A, therefore making the joint length formed by jointing the transmission rod 120 and the driving plate 130 applicable to the second door 300B.

Figure 11:
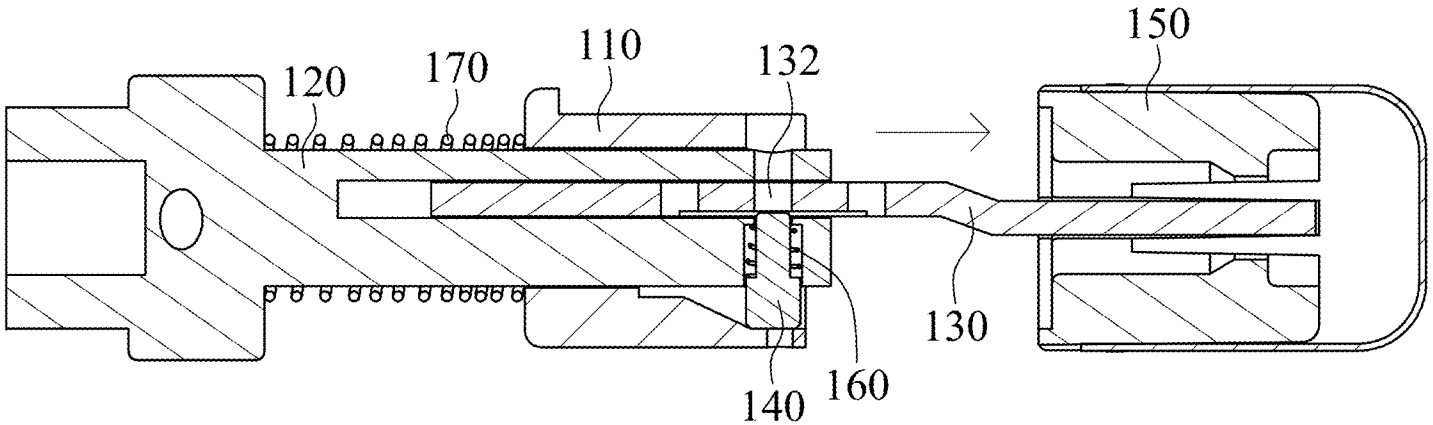
FIG. 11 is a section view illustrating the button of the adjustable button apparatus of the lock in accordance with the embodiment of the present invention.

In order to change the insertion position that the positioning pin 140 is inserted into the driving plate 130, moving the adjusting sleeve 110 toward the left direction or toward the direction of the second elastic member 170 from the positioning position (FIG. 4) to the adjusting position (FIG. 5), maintaining the adjusting sleeve 110 in the adjusting position and making the second elastic member 170 under compression. Owning to the height difference between the first bearing position 113*a* and the second bearing position 113*b*, the fixing portion 142 of the positioning pin 140 enables to be pressed by the first elastic member 160 to move from the first bearing position 113*a* to the second bearing position 113*b*, meanwhile, the positioning portion 141 of the positioning pin 140 separates apart from the positioning hole 132 of the driving plate 130 so that the driving plate 130 is transversely movable in the insertion hole 122 of the transmission rod 120. Referring to FIG. 11, in the second type for usage, drawing out the driving plate 130 and revealing another size mark 133 via the opening 114 to make the positioning portion 141 of the positioning pin 140 correspond to another positioning hole 132. Eventually, referring to FIG. 8, releasing the adjusting sleeve 110 to make the second elastic member 170 not being compressed, therefore, the adjusting sleeve 110 is movable toward the right direction or the direction of the button 150 from the adjusting position (FIG. 11) to the positioning position, the fixing portion 142 of the positioning pin 140 is pressed by the first ring wall 111 of the adjusting sleeve 110 to move from the second bearing position 113*b* to the first bearing position 113*a*. When the positioning pin 140 is located at the first bearing position 113*a*, the positioning portion 141 of the positioning pin 140 is inserted into another positioning hole 132 of the driving plate 130 to make the positioning pin 140 engage with the transmission rod 120 and the driving plate 130.

The adjustable button apparatus of the lock 100 of the present invention enables to adjust the joint length formed by jointing the transmission rod 120 and the driving plate 130 without using a tool and makes the lock applicable for installation in doors of various door thicknesses. When the adjusting sleeve 110 of the present invention is located at the positioning position, the positioning pin 140 is pressed by the adjusting sleeve 110 to make the positioning pin 140 inserted into the driving plate 130 and engaged with the transmission rod 120 and the driving plate 130 so that the transmission rod 120 and the driving plate 130 act simultaneously. When the joint length longs for adjustment, the adjusting sleeve 110 moves from the positioning position to the adjusting position to make the positioning pin 140 separate apart from the driving plate 130 so that the driving plate 130 is transversely movable in the transmission rod 120 for adjusting the joint length formed by jointing the transmission rod 120 and the driving plate 130. Thereafter, the adjusting sleeve 110 moves from the adjusting position to the positioning position so as to make the positioning pin 140 pressed by the adjusting sleeve 110 once again and force the positioning pin 140 to insert into the driving plate 130 for achieving joint length adjustment.

While this invention has been particularly illustrated and described in detail with respect to the preferred embodiments thereof, it will be clearly understood by those skilled in the art that it is not limited to the specific features and describes and various modifications and changes in form and details may be made without departing from the spirit and scope of this invention.

What is claimed is:

1. An adjustable button apparatus of a lock includes:

an adjusting sleeve having a first ring wall and an accommodating space surrounded by the first ring wall, wherein the adjusting sleeve is movable between a positioning position and an adjusting position;

a transmission rod inserted into the accommodating space of the adjusting sleeve and having a second ring wall and an insertion hole surrounded by the second ring wall, wherein the second ring wall comprises an inner surface and a limiting hole recessed to the inner surface and communicating with the insertion hole, the transmission rod being configured to drive a transmission mechanism of the lock;

a driving plate inserted into the insertion hole and having a body and a plurality of positioning holes formed at the body;

a button engaged with the driving plate; and a positioning pin disposed within the limiting hole of the transmission rod, when the adjusting sleeve is located at the positioning position, the positioning pin is pressed by the first ring wall of the adjusting sleeve to make the positioning pin inserted into one of the positioning holes of the driving plate and to make the driving plate engaged with the transmission rod, otherwise, when the adjusting sleeve is located at the adjusting position, the positioning pin separates apart from the positioning hole to make the driving plate movable in the insertion hole of the transmission rod.

2. The adjustable button apparatus of a lock in accordance with claim 1, wherein the first ring wall of the adjusting sleeve comprises an interior surface and a guiding slot recessed to the interior surface, the guiding slot comprises a first leaning position and a second leaning position, wherein a first interval is defined between the first leaning position and the interior surface, a second interval is defined between the second leaning position and the interior surface, the second interval is larger than the first interval, when the adjusting sleeve is located at the adjusting position, the positioning pin contacts against the second leaning position.

3. The adjustable button apparatus of a lock in accordance with claim 2, wherein the guiding slot further comprises a ramp surface connected to the first leaning position and the second leaning position, the ramp surface is located between the first leaning position and the second leaning position.

4. The adjustable button apparatus of a lock in accordance with claim 1, further includes a first elastic member disposed within the limiting hole, the first elastic member comprises a first end and a second end, the first end contacts against the transmission rod, and the second end presses the positioning pin to make the positioning pin contact against the adjusting sleeve.

5. The adjustable button apparatus of a lock in accordance with claim 4, wherein the limiting hole comprises a hole surface and a protrusion protruded from the hole surface, the positioning pin comprises a positioning portion and a fixing portion, the positioning portion protrudes from the fixing portion, the first end of the first elastic member contacts against the protrusion, the second end of the first elastic member contacts against the fixing portion to make the fixing portion protruded from the second ring wall.

6. The adjustable button apparatus of a lock in accordance with claim 1 further includes a second elastic member having a first bearing terminal and a second bearing terminal, the transmission rod further comprises a blocking portion protruded from the second ring wall, the first bearing terminal of the second elastic member contacts against the adjusting sleeve, and the second bearing terminal of the second elastic member contacts against the blocking portion.

7. The adjustable button apparatus of a lock in accordance with claim 1, wherein the driving plate further comprises a plurality of size marks formed on the body, and the adjusting sleeve reveals one of the size marks.

8. The adjustable button apparatus of a lock in accordance with claim 7, wherein the adjusting sleeve further comprises an opening formed at the first ring wall, the size mark is revealed by the adjusting sleeve via the opening.

9. The adjustable button apparatus of a lock in accordance with claim 1, wherein the positioning holes of the driving plate penetrate through the body.

10. An adjustable button apparatus of a lock includes:

an adjusting sleeve having a first ring wall and an accommodating space surrounded by the first ring wall, wherein the adjusting sleeve is movable between a positioning position and an adjusting position;

a driving plate inserted into the adjusting sleeve and having a body and a plurality of positioning holes formed at the body;

a button engaged with the driving plate; and a positioning pin movably disposed within the adjusting sleeve and biased toward an interior surface of the first ring wall, when the adjusting sleeve is located at the positioning position, the positioning pin is pressed by the first ring wall of the adjusting sleeve to make the positioning pin inserted into one of the positioning holes of the driving plate to make the driving plate fixedly positioned, otherwise, when the adjusting sleeve is located at the adjusting position, the positioning pin is biased to separate apart from the positioning hole to make the driving plate movable.

11. The adjustable button apparatus of a lock in accordance with claim 10, further including a transmission rod inserted into the accommodating space of the adjusting sleeve, the transmission rod comprises an insertion hole, the driving plate is inserted into the insertion hole, and the positioning pin is engaged with the transmission rod, the transmission rod being configured to drive a transmission mechanism of the lock.

12. The adjustable button apparatus of a lock in accordance with claim 11, wherein the transmission rod comprises a second ring wall surrounding the insertion hole, the second ring wall comprises an inner surface and a limiting hole recessed to the inner surface, the limiting hole communicates with the insertion hole, and the positioning pin is disposed within the limiting hole.

13. The adjustable button apparatus of a lock in accordance with claim 12, wherein the first ring wall of the adjusting sleeve comprises a guiding slot recessed to the interior surface, the guiding slot comprises a first leaning position and a second leaning position, wherein a first interval is defined between the first leaning position and the interior surface, a second interval is defined between the second leaning position and the interior surface, the second interval is larger than the first interval, when the adjusting sleeve is located at the adjusting position, the positioning pin contacts against the second leaning position.

14. The adjustable button apparatus of a lock in accordance with claim 13, wherein the guiding slot further comprises a ramp surface connected to the first leaning position and the second leaning position, the ramp surface is located between the first leaning position and the second leaning position.

15. The adjustable button apparatus of a lock in accordance with claim 12 further includes a first elastic member disposed within the limiting hole, the first elastic member comprises a first end and a second end, the first end contacts against the transmission rod, and the second end presses the positioning pin to make the positioning pin contact against the adjusting sleeve.

16. The adjustable button apparatus of a lock in accordance with claim 15, wherein the limiting hole comprises a hole surface and a protrusion protruded from the hole surface, the positioning pin comprises a positioning portion and a fixing portion, the positioning portion protrudes from the fixing portion, the first end of the first elastic member contacts against the protrusion, the second end of the first elastic member contacts against the fixing portion to make the fixing portion protruded from the second ring wall.

17. The adjustable button apparatus of a lock in accordance with claim 12 further includes a second elastic member having a first bearing terminal and a second bearing terminal, the transmission rod further comprises a blocking portion protruded from the second ring wall, the first bearing terminal of the second elastic member contacts against the adjusting sleeve, and the second bearing terminal of the second elastic member contacts against the blocking portion.

18. The adjustable button apparatus of a lock in accordance with claim 12, wherein the driving plate further comprises a plurality of size marks formed on the body, and the adjusting sleeve reveals one of the size marks.

19. The adjustable button apparatus of a lock in accordance with claim 18, wherein the adjusting sleeve further comprises an opening formed at the first ring wall, the size mark is revealed by the adjusting sleeve via the opening.

* * * * *